US006120199A

United States Patent [19]

Takekoshi

[11] Patent Number: 6,120,199

[45] **Date of Patent: *Sep. 19, 2000**

[54] INK JET PRINTING APPARATUS WITH HEATING UNIT AND INSULATING MEMBER

[75] Inventor: Nobuhiko Takekoshi, Kawasaki, Japan

[73] Assignee: Canon Kabushiki Kaisha, Tokyo, Japan

[ * ] Notice: This patent issued on a continued prosecution application filed under 37 CFR 1.53(d), and is subject to the twenty year patent term provisions of 35 U.S.C. 154(a)(2).

[21] Appl. No.: 09/025,652

[22] Filed: Feb. 18, 1998

[30] Foreign Application Priority Data

Feb. 19, 1997 [JP] Japan ..... 9-035374
Feb. 13, 1998 [JP] Japan ..... 10-031225

[51] Int. Cl.[7] ..... B41J 29/377; B41J 29/00

[52] U.S. Cl. ..... 400/611; 400/679; 347/102

[58] Field of Search ..... 347/102; 400/118.2, 400/611, 613, 679, 694

[56] References Cited

U.S. PATENT DOCUMENTS 4,947,190 8/1990 Mizusawa et al. ..... 400/126
5,252,992 10/1993 Fukushima et al. ..... 347/43
5,444,468 8/1995 Fukushima et al. ..... 347/14
5,614,928 3/1997 Matsuda ..... 347/2

FOREIGN PATENT DOCUMENTS 1-182081 7/1989 Japan ..... 347/102
2-241747 9/1990 Japan .
5-84896 4/1993 Japan .
7-237348 9/1995 Japan .
8-002090 1/1996 Japan .

*Primary Examiner*—Ren Yan
*Assistant Examiner*—Daniel J. Colilla
*Attorney, Agent, or Firm*—Fitzpatrick, Cella, Harper & Scinto

[57] ABSTRACT

An ink jet printing apparatus includes an ink jet printing unit for executing ink jet printing on a printing medium by use of an ink jet printing head, a heat application treatment unit arranged below the ink jet printing unit for executing heat treatment to a printing medium after the execution of ink jet printing in the ink jet printing unit, and a heat insulating member arranged between the ink jet printing unit and the heat application treatment unit. Thus, this apparatus is made capable of preventing heat generated by the heat application treatment unit from producing any unfavorable effect that may invite the degradation of printing quality if such heat is transferred to the various members in the apparatus, such as the ink jet printing unit, the printing medium storage unit, or to the bending portion of a printing medium between the ink jet printing unit and printing medium storage unit.

86 Claims, 6 Drawing Sheets

INK JET PRINTING APPARATUS WITH HEATING UNIT AND INSULATING MEMBER

BACKGROUND OF THE INVENTION

1. Field of the Invention

The present invention relates to an ink jet printing apparatus provided with a heat application treatment unit that gives heat treatment to a medium having ink jet prints formed on it.

2. Related Background Art

Conventionally, as a printing medium having a thermoplastic layer on the printing side, there has been known the medium which is provided with a porous polymeric layer formed on the printing surface thereof (such as disclosed in Japanese Patent Laid-Open Application No. 7-237348). The porous polymeric layer becomes the transparent polymeric film that protects the printed surface when thermally treated. Also, in accordance with Japanese Patent Laid-Open Application No. 8-2090, there is disclosed a printing medium having a resin porous layer formed on the printing surface thereof. The resin porous layer becomes the transparent resin film that protects the printed surface when thermally treated.

When a heat treatment is given to the ink droplets discharged onto the porous polymeric layer of a printing medium after the ink droplets have been permeated into the ink retention layer formed under the porous polymeric layer, a considerable amount of water vapor is generated due to the evaporation of the moisture contained in them as a large amount of heat and ink solvent. A phenomenon of the kind is not necessarily confined only to the case of the printing medium described above. This phenomenon also takes place when the heating fixation is performed after the ink jet printing is made on an ordinary paper sheet.

The heat which is generated by the heating fixation after an ink jet printing is executed produces an unfavorable effect on the ink jet printing head and other in the printing unit installed in the apparatus main body or on the printing medium if it is stored in the interior of the apparatus main body. For example, there is a problem that the discharge openings of an ink jet printing head of may be clogged due to dried liquid of ink in the discharge openings or the printing medium may be deformed in the printing medium storage provided in the interior of the apparatus.

Particularly, if a structure is arranged so that the heating fixation unit is installed on the lower part of an ink jet printing unit for the purpose of maintaining the printing apparatus in a smaller size, the heat generated on the lower part of the apparatus is allowed to be transferred upward, thus affecting the ink jet printing unit arranged above the heating fixation unit, among some other problems encountered as described above.

Further, if a printing medium stored in the apparatus is a rolled paper, it is curled more easily. Then, when such curled paper sheet is used for ink jet printing, there is a problem that the printing medium tends to be in contact with the ink jet printing head.

Further, if the printing medium stored in the apparatus is the one which is provided with porous polymeric layer on the printing surface thereof, there is a problem that the porous property of the medium may be deteriorated by heat in some cases.

Furthermore, there is a problem that the water vapor generated in the heating fixation unit by the evaporation of moisture contained in the solvent of ink produces unfavorable effect on the ink jet printing head and printing medium as well.

SUMMARY OF THE INVENTION

The present invention is designed to solve the problems described above. It is an object of the invention to provide an ink jet printing apparatus capable of preventing various members in it from being affected by the unfavorable effect that may be produced by heat generated in the heat application treatment unit so as not to invite any degradation of printing quality.

It is another object of the invention to provide an ink jet printing apparatus capable of preventing various members in it from being affected by the unfavorable effect that may be produced by water vapor generated in the heat application treatment unit so as not to invite any degradation of printing quality.

It is still another object of the invention to provide an ink jet printing apparatus capable of preventing the ink jet printing unit or the printing medium storage in it from being affected by the unfavorable effect that may be produced by heat generated in the heat application treatment unit so as not to invite any degradation of printing quality.

It is a further object of the invention to provide an ink jet printing apparatus capable of preventing the ink jet printing unit or the printing medium storage in it from being affected by the unfavorable effect that may be produced by water vapor generated in the heat application treatment unit so as not to invite any degradation of printing quality.

It is still a further object of the invention to provide an ink jet printing apparatus comprising an ink jet printing unit that executes ink jet printing on a printing medium by use of an ink jet printing head; a heat application treatment unit arranged under the ink jet printing unit, which gives heat treatment to a printed medium subsequent to the ink jet printing executed in the ink jet printing unit; and a heat insulating member arranged between the ink jet printing unit and the heat application treatment unit.

DETAILED DESCRIPTION OF THE PREFERRED EMBODIMENTS

Figure 1:
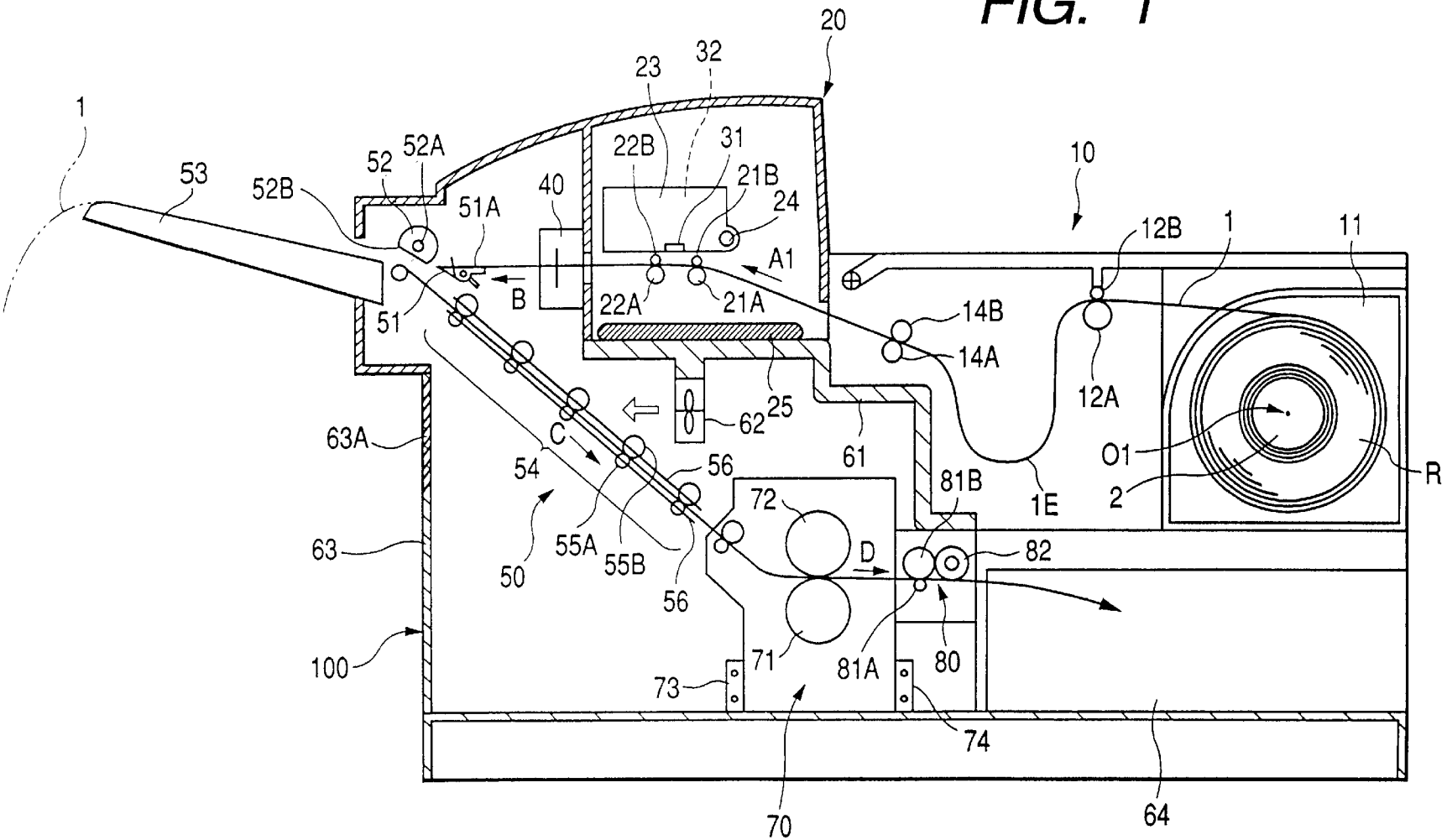
FIG. 1 is a view which schematically shows the entire structure of an image formation apparatus according to a first embodiment of the present invention.

Hereinafter, with reference to the accompanying drawings, the description will be made of the embodiments in accordance with the present invention.

(First Embodiment)

At first, in conjunction with FIG. 4, the description will be made of the structural example of a printing medium 1 which is usable for the present invention.

A reference numeral 1A designates the base material whose main component is vegetable fiber, such as paper or PET (polyethylene terephthalate) film. On the upper surface thereof, there are coated one after another an ink absorbing layer 1B, an ink fixing layer 1C, and a thermoplastic layer 1D that has liquid permeability or liquid holding capability in that order. The layer 1D can be formed by a porous and thermally fusible resin, for example. Therefore, the layer 1D is hereinafter referred to as a latex layer, although it is clear that the layer 1D is not necessarily limited only to the latex layer.

Ink discharged from the ink jet printing head passes the latex layer 1D and reaches the ink fixing layer 1C, and then, the ink absorbing layer 1B. Ink is fixed on the ink fixing layer 1C, thus forming an image. Ink which moves from the ink fixing layer 1C to the ink absorbing layer 1B is absorbed in it.

After an image is printed on a printing medium, the latex layer 1D is pressed while being heated, hence generating such irreversibility as to lose the porosity of the latex layer 1D. In this case, as shown in FIG. 4, the printing medium 1 is allowed to pass between the heated upper and lower rollers Ri and R2, for example. In this manner, the latex layer 1 is pressed, while being heated. When heated, the latex layer 1 is fused and coagulated to make it transparent. The latex layer 1D which is made irreversible to lose its porosity forms a highly durable protection layer on the surface of the printed medium.

Figure 4:
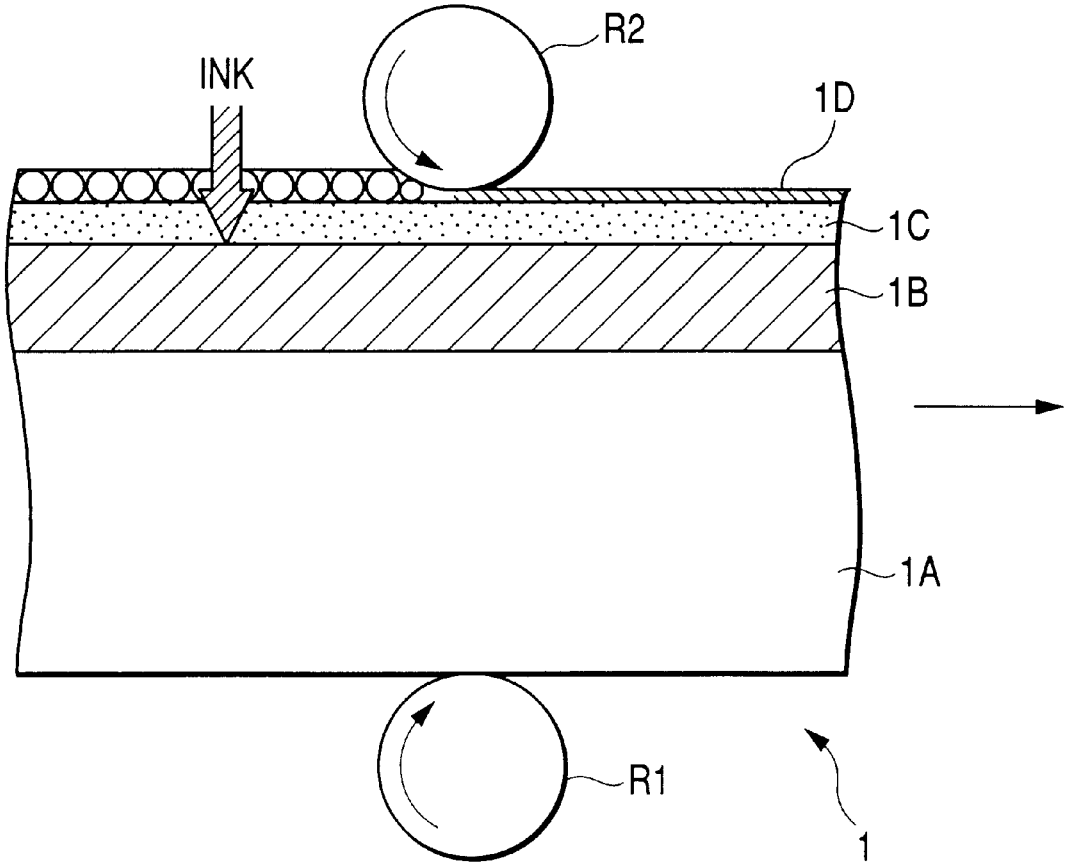
FIG. 4 is a cross-sectional view which illustrates the structural example of a printing medium which is provided with a porous thermoplastic resin layer.

Also, on the lower surface of the base material 1A shown in FIG. 4, a back coating may be applied in order to enhance its moisture proof capability or the like. As the base material 1A, a baryta paper, which is provided with a barium sulfate layer formed on it to provide white color, may be used, among some others. Further, in order to make both faces of a printing medium printable, it may be possible to coat the ink absorbing layer 1B, ink fixing layer 1C, and latex layer 1D on the lower face side of the base member 1A shown in FIG. 4. In this case, images can be printed on the surface and reverse sides of a printing medium. also, the porosity of the latex layer 1D on each face can be disposed of irreversibly at a time.

FIG. 1 is a view which schematically illustrates a printing apparatus in accordance with a first embodiment of the present invention. In FIG. 1, a reference numeral 10 designates supply means for feeding a printing medium. For the present embodiment, this means is structured to roll out and supply a rolled printing medium designated by a reference mark R. The printing medium 1 is formed as described in conjunction with FIG. 4 and stored in the rolled form as at R in FIG. 1. The printing surface having the latex layer 1D formed on it is set to face externally. In other words, the printing medium 1, which is externally rolled, is set with its printing surface on the outer side. A reference numeral 2 designates a paper tube on which the printing medium is rolled. This paper tube is axially and rotatively supported around the axial center 01 in a cartridge type storage 11. The cartridge type storage 11 that contains the printing medium 1 is installed in a specific position in the printing apparatus main body 100 as shown in FIG. 1.

The printing medium 1 is fed from the cartridge type storage 11 by means of the roller pairs 12A, 12B and 14A, 14B, and supplied in direction of arrow A1 to the printing unit 20 serving as printing means. At this juncture, the printing medium carrier path between the rollers 12A, 12B and rollers 14A, 14B is arranged to enable the printing medium to form a convex loop 1E by means of its own weight. This arrangement of the loop 1E not only releases the carrier system of the printing unit from the load required for drawing out the printing medium from the roller R in order to secure the precise carrying accuracy for the printing unit 29, but also, removes the curling behavior, which has been acquired by the printing medium in the direction in which it is rolled around the roller R, by bending it in the direction opposite to the curling thus developed on the printing medium.

On the printing medium, images are formed between the roller pairs 21A, 21B and 22A, 22B by means of ink discharged from the ink discharge openings of the ink jet head 31. The printing head 31 is mounted on the carriage unit 23 together with an ink tank 32. The carriage unit 24 is guided by the shaft 23 that extends in the direction almost orthogonal to the carrying direction of the printing medium 1. Along the shaft 24, the carriage unit reciprocates (hereinafter referred to as the "main scanning direction"). The printing head 31 and the ink tank 32 may be arranged to form an integrated ink jet cartridge. The carriage unit 23 and the printing head 31 reciprocate together in the main scanning direction to discharge ink from the printing head 31, thus printing images on the printing medium 1. Then, per reciprocation of the carriage unit 23, the printing medium 1 is fed per specific amount in the direction indicated by an arrow B. The printing medium is supplied from the interior of the cassette 11 sequentially.

The printing head 31 is structured to discharge ink from the ink discharge openings by the utilization of thermal energy, for example. In such case, ink paths conductively connected with each of ink discharge openings are formed for the printing head 31. Further, electrothermal transducing devices are formed corresponding to the ink paths, respectively. Each of the electrothermal transducing devices generates heat in response to the driving pulses applied in accordance with printing data. Then, by means of heat thus generated, film boiling is created in ink. With the development and contraction of each air bubble brought about by the film boiling, each of ink droplets is discharged from the corresponding ink discharge opening.

Also, the printing head 31 may be arranged to use electromechanical transducing devices, such as piezoelectric devices, that generate the respective voluminal changes when electrical energy is applied, and then, the structure is formed to discharge ink from the ink discharge openings in accordance with such voluminal changes.

Also, the carriage unit 23 may be arranged to mount a plurality of printing heads 31 to print color images. In such case, cyan (C), magenta (M), yellow (Y) and black (B) ink may be used, among some others, or darker and brighter ink of the same color may be used. For example, as cyan (C) and magenta (M), darker and brighter ink may be used for each of them.

Here, a reference numeral 40 designates a cutter unit serving as cutting means. The cutter unit 40 is provided with a cutter that cuts to a specific length the printing medium 1 having images printed on it.

A reference numeral 50 designates shock absorbing means for adjusting the carrier speed of the printing medium. Such speeds are different between the units. After the printing medium 1 is guided into this means after images are printed on it in the printing unit 20, it is, delivered onto the fixing unit 70 which will be described later.

A reference numeral 51 designates a switching lever which is arranged to be rotatively centered on the shaft 51A.

This lever can be selectively set in the rotational position indicated by solid line, and in the rotational position indicated by broken line as required. When the switching lever 51 is placed in the rotational position indicated by the solid line in FIG. 1, it is possible to exhaust the printing medium 1 in the direction indicated by the arrow B after printing.

A reference numeral 52 designates a D cut roller whose sectional surface is in the D-letter form. This roller is rotatively and axially supported by the shaft 52A so that it can reciprocate. When the printing medium 1 is exhausted in the direction indicated by the arrow B after printing, the D cut roller 52 is in the rotational position shown in FIG. 1. Here, a reference numeral 52B designates the flat cut surface formed on the D cut roller 52.

A reference numeral 53 designates an intermediate tray which is removable. The printing medium 1 is stacked on it after printing. The length of the intermediate tray 53 is assumed to be substantially the same as the width of an A4 sized sheet, for example. If an elongated printing medium should be stacked, a part of such printing medium 1 hangs down from the leading end of the intermediate tray 53 as indicated by two-dot chain line in FIG. 1. After printing on the printing unit 20, the printing medium 1 is positioned on this intermediate tray, and then, carried into the carrier path 54, which will be described later, by means of the rotation of the switching lever 51 to the rotational position indicated by the broken line in FIG. 1, and also, by the counterclockwise rotation of the D cut roller 52.

For the shock absorbing means 50, the carrier path 54 is provided to carry the printing medium 1 onto the fixing unit 70 which will be described later. This carrier path 54 is provided with five sets of roller pairs 55A and 55B, and the guiding plates 56 and 56 which also form a pair. The rollers 55A and 55B are rotated by means of a motor (not shown) to enable the printing medium 1 after printing to be carried in the direction indicated by arrow C. On the guiding plate 56, an elongated hole is formed for air ventilation. Also, if the printing medium 1 is jammed in the carrier path 54, the guiding plates 56 and 56 are allowed to seperate to open the space between the guiding plates 56 and 56 by means of a mechanism (not shown).

A reference numeral 61 designates a heat insulating member. This is a member that contains an air layer in its interior for insulating heat, and arranged to separate the cartridge type storage 11 that stores the printing medium, the loop 1E portion of the printing medium, and the printing unit 20 from the fixing unit 70 and the decurling unit 80 which will be described later. The heat insulating member 61 is arranged so as not to allow heat generated in the fixing unit 70 to be transferred to the loop 1E portion of the printing medium 1, the printing unit 20, and the cartridge type storage 11. In accordance with the present embodiment, the fixing unit 70 and the decurling unit 80 are arranged on the lower part of the ink jet printing unit 20 as a heat application treatment unit in order to make the printing apparatus more compact as a whole. Therefore, heat generated in the heat application treatment unit makes the air around the heat application treatment unit warmer to allow it to ascend, hence raising the temperature around the ink jet printing head arranged in the ink jet printing unit which is located where the warmer air ascends. The provision of the heat insulating member is effective in preventing those unfavorable events from taking place. Otherwise, the heat thus generated by the warmer air may result in such unfavorable events as the clogging of ink nozzles by the solidified ink due to the evaporation of ink solvent in the discharge openings of the ink jet printing head; the rolling behavior of the printing medium stored in the printing medium storage whose interior becomes warmer to dry the printing medium particularly when it is rolled; the looping behavior acquired by the printing medium if the printing medium is heated on the loop 1E portion; and the degradation of printing quality if the printing medium is provided with a thermoplastic resin layer due to the deterioration of the thermoplastic resin layer, which is caused by heat generated in the heat application treatment unit, among some others.

In FIG. 1, there is arranged on the upper side of the heat insulating member 61 but lower side of the printing unit 20 or the lower vicinity thereof a waste ink reservoir member 25 that retains the waste ink produced by the idle discharges, as well as the suction recovery to maintain the discharge performance of the ink jet printing head. It is desirable to make an arrangement so that the waste ink retained in this waste ink reservoir member 25 should be evaporated naturally for maintaining the capacity of the waste ink retention of this member. It is not advisable to allow the waste ink to be evaporated more than the amount that can be evaporated naturally, because then a large amount of water vapor or water droplets are generated to create a problem that the quality of ink jet printing is degraded after all. Therefore, the waste ink reservoir member 25 is located above the heat insulating member 61, thus avoiding being affected by heat generated in the heat application treatment unit so as not to allow any excessive evaporation of the waste ink. Here, the waste ink reservoir member 25 is structured to be replaceable if the limit of its retention capability is reached.

A reference numeral 62 designates a fan which is located below the heat insulating member and above the fixing unit, and blows the hot air in the interior of the apparatus to the carrier path 54 side. As described earlier, the carrier path 54 is provided with the elongated hole. Therefore, if there is no printing medium existing in the carrier path 54, the hot air can escape through the elongated hole. On the other hand, if the printing medium 1 is present in the carrier path, the hot air blows onto the printing medium 1 through the elongated hole, thus making it possible to give pre-heating to the printing medium 1 before being heated in the fixing unit 70 which will be described later. As a result, if the printed images are darker, or the like, ink on the surface of the latex layer 1D can be dried effectively. Here, a reference numeral 63 designates an outer cover where the louver portion 63A is formed, hence making it possible to allow the hot air passing through the elongated hole of the carrier path 54 to be exhausted outside the apparatus smoothly.

A reference numeral 70 designates the fixing unit which is provided with a pair of rollers 71 and 72 rotatively arranged with heaters incorporated in them. The rollers 71 and 72 heat the printing medium 1 while pressing it under a specific pressure, and carry it in the direction indicated by arrow D. When the printing medium 1 passes between the roller 71 and 72 while being heated under pressure, the latex layer 1D thereof is fused, and then, coagulated to make it transparent as described earlier. With the transparent latex layer 1D thus fused and coagulated, the highly durable protection layer is formed on the surface of the printing medium without spoiling the quality of printed images. Hereinafter, the changes of printing medium 1 followed by the changes of the latex layer 1D are referred to as "heating fixation".

The printing medium 1 thus treated with the heating fixation is delivered to the exhaust outlet 64 outside the apparatus through the decurling unit 80 serving as decurling means for improving the flatness of the printing medium. The decurling unit 80 is provided with a pair of rollers 81A and 81B, and a heating roller 82 having heater incorporated in it. The rollers 81A and 81B are heated by means of the heating roller 82.

The decurling unit 80 and fixing unit 70 are arranged to be withdrawn outside the apparatus along the rails 73 and 74 if the printing medium 1 is jammed in these units while it passes through them. Here, the decurling unit 80 and the fixing unit 70 may be structured separately, but if these units are formed integrally, it becomes easier to dispose of the jammed printing medium 1 without cutting it or without causing any damage to the rollers when the printing medium is jammed crossing over these two units.

Figure 2:
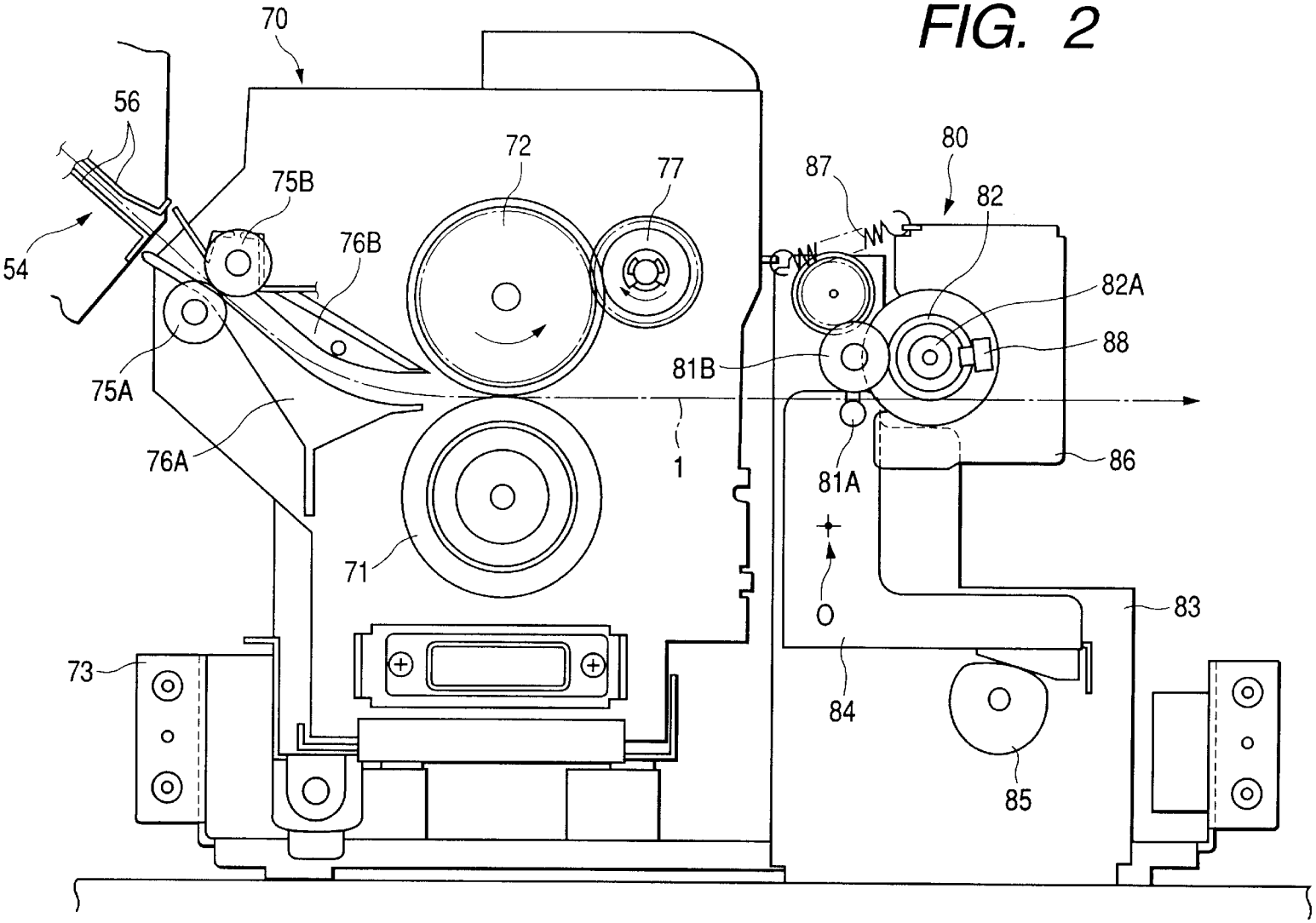
FIG. 2 is an enlarged view which illustrates the fixing unit and decurling unit represented in FIG. 1.
Figure 3:
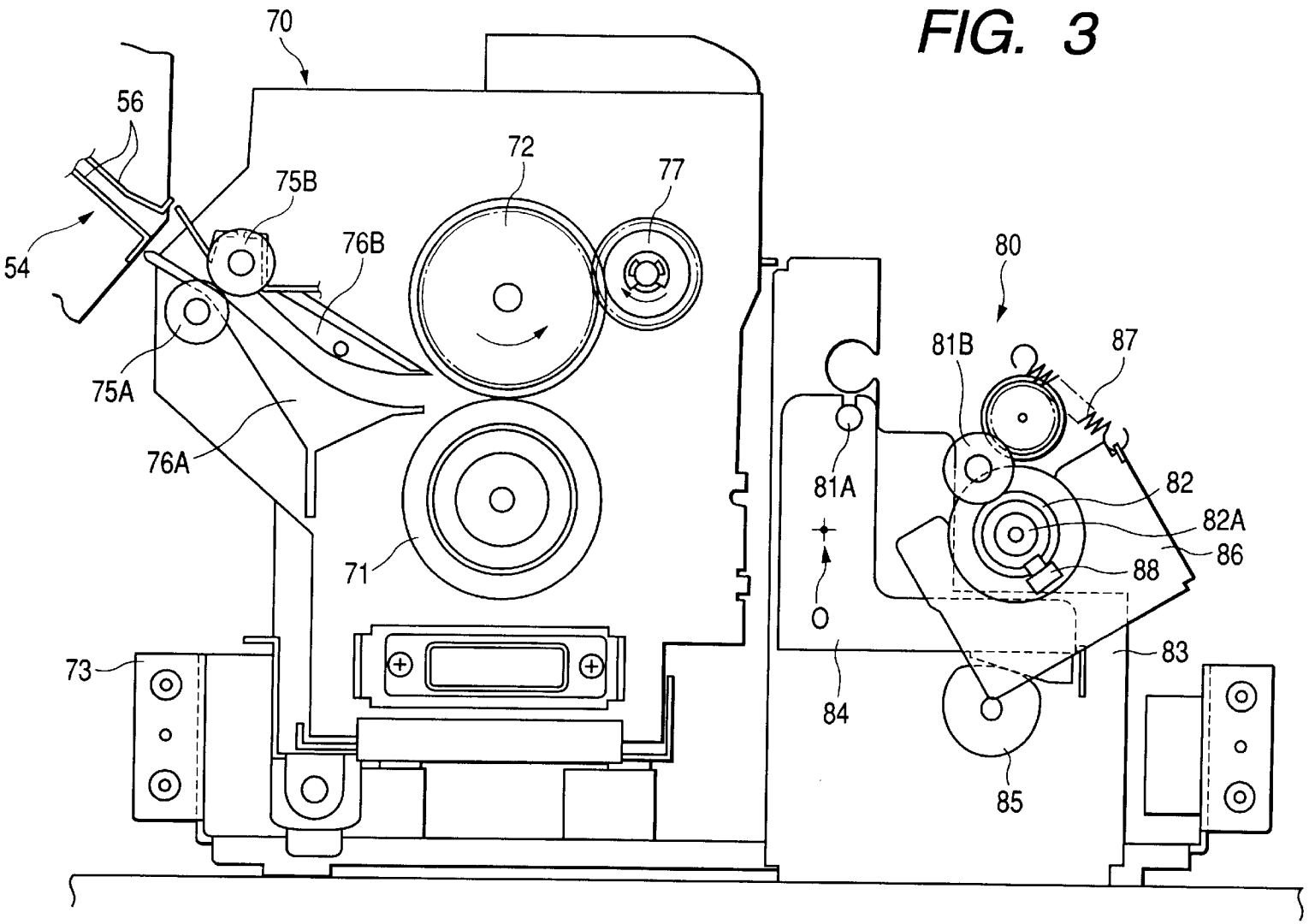
FIG. 3 is a view which illustrates the state where the decurling unit shown in FIG. 2 is open.

FIG. 2 and FIG. 3 are enlarged views which illustrate the fixing unit 70 and decurling unit 80 serving as a heat application treatment unit.

In the fixing unit 70, reference numerals 75A and 75B designate a pair of carrier rollers. With these rollers 75A and 75B, the printing medium 1 is carried between the pressure roller 71 and the fixing roller 72 from the carrier path 54 through a pair of carrier guides 76A and 76B. As described earlier, heaters are incorporated in the roller 71 and 72. The temperature control thereof is executed by temperature control means as described later. Here, a reference numeral 77 designates a cleaning roller that cleans the surface of the fixing roller 72.

Now, when the latex layer 1D of the printing medium 1 is fused, and then, coagulated to be fixed by heating, the irregularities of the surface of the fixing roller 72 tend to be transferred to the surface of the latex layer 1D. Hereinafter, the thermally fixed latex layer 1D is referred to as "laminated layer". In general, when PET (polyethylene terephthalate) is used for a compression molding without any fillers, the sense of coarse particles is produced if the ten-point average coarseness RZ is 5 $\mu$m <RZ≦10 $\mu$m for the surface thereof, and the sense of mirror surface is produced if the RZ≦5 $\mu$m. Likewise, in the case of a printing medium 1, the glossiness of the surface of laminated layer brings about the clearness of the image quality. Therefore, it is preferable to set the ten-point average coarseness RZ at 5 $\mu$m or less for the surface coarseness of the fixing roller 72 that contacts the printing surface of the printing medium 1 under pressure or more preferably, the RZ is set at 1.5 $\mu$m or less.

The base 83 of the decurling unit 80 is integrally connected with the fixing unit 70 in accordance with the present embodiment. Thus, the fixing unit 70 and the decurling unit 80 are structured to be withdrawn together. The roller 81A is a robust metallic roller. The roller 81B is an elastic roller formed by rubber or some other elastic material. Here, the roller 81A may be referred to as a "metallic roller", and the roller 81B, a "rubber roller". The metallic roller 81A is axially supported by a slider 84. The slider 84 is slidably guided in the direction from the top to the bottom in FIG. 2. For the set position of the base 83, a cam 85 is rotatively arranged to adjust and move the slider 84 in the vertical direction. The cam 85 is controlled by decurling pressure controlling means which will be described later.

The heating roller 82 is in contact with the rubber roller 81B to heat the rubber roller 81B. The heater 82A, which is incorporated in the heating roller 82 is controlled by temperature controlling means which will be described later. Between the rubber roller 81B thus heated and the metallic roller 81A, the printing medium 1 is effectively decurled under pressure while being heated. The rubber roller 81B and heating roller 82 are axially supported by a case 86. The case 86 is supported on the base 83 to be freely opened or closed around the center of shaft 0 which extends in the direction from the front to the back on the surface of FIG. 2. FIG. 2 represents the state where the case 86 is closed. FIG. 3 illustrates the state where the case 86 is open. Here, a reference numeral 87 designates a spring tensioned between the case 86 and the fixing unit 70. With this spring 87, the case 86 is kept in the state of being closed. When the case 86 should be open, the spring 87 is removed as shown in FIG. 3. Here, a reference numeral 88 designates a thermistor that detects the temperature of the heater 82A and feeds it back to the temperature controlling means.

Now, in this decurling unit 80, the rubber roller 81B is indirectly heated through the heating roller 82. The reasons why such arrangement is made are given below. In other words, if a heater is incorporated in the rubber roller 81B to enhance the heat transfer efficiency, the rubber roller 81B becomes hardened. On the other hand, if the metallic roller 81A is arranged to be heated, the printing medium 1 should be heated from its reverse side, and the heating efficiency becomes unfavorable.

Now, the description will be made of the specific control of the fixing unit 70 and the decurling unit 80.

At first, the carrier speeds VA and VB of the printing medium 1 in the units 70 and 80, and the carrying speed VC of the printing medium 1 in the carrier path 54 are controlled to maintain the relationship of VC<VA<VB in order to secure the stability of the fixing speed and the carrier speed of the printing medium 1.

With such speed control, it becomes possible to prevent the printing medium 1 from presenting its looped form before and after the fixing unit 70. If the printing medium 1 is slackened to create any looped form before entering between the rollers 71 and 72, the printing medium 1 abuts upon the fixing roller 72, thus damaging the smoothness of the laminated layer because of the heated fixing roller 72. Also, if the printing medium 1 is slackened to create any looped form between the fixing unit 70 and decurling unit 80, the printing medium 1 that comes out between the roller 71 and 72 is pulled to the fixing roller 72 side. Thus, there is a fear that the printing medium 1 is wound around the roller 72.

In the meantime, it is preferable to keep the printing medium 1 in the state of straight line before the heat given to it has not been radiated as yet, hence preventing it from being curled. The speed control described above also becomes effective in this aspect. Now, if the printing medium 1 is bent before the latex layer 1D has been coagulated subsequent to being fused and cooled, the coagulation of the latex layer 1D is complete while the curved form of the printing medium remains as it is. This may result in the creation of curling of the printing medium 1 after all.

In order to prevent the creation of curling of the printing medium 1 before and after the fixing unit 70, the arrangement may be made so that the carrying force on the carrier path 54 is released the moment the printing medium 1 has arrived at the gap between the rollers 71 and 72, and then, it is further carried by the application of the carrying force exerted by the rollers 71 and 72. Also, the structure may be arranged so that when the printing medium 1 is under control between the rollers 71 and 72, slippage is allowed to take place in the driving system of rollers in the carrier path 54 and decurling unit 80, while no particular difference is set between the carrying speeds of the printing medium 1 in the units 70 and 80, and the carrier path 54.

For the temperature control for the rollers 71 and 72 in the fixing unit 70, the lower limit and upper limit temperatures are set in consideration of the aspects given below.

At first, the lower limit of the temperature for the rollers 71 and 72 is approximately the transition temperature of the latex layer 1D of the printing medium 1 to glass. In other words, if the latex layer 1D is not fused because of the lower heating temperature, there occurs a large friction and affinity forces between the latex layer 1D, which is designed to absorb ink sufficiently, and the fixing roller 72, which is formed by silicone rubber or the like. As a result, the printing medium 1 whose latex layer 1D has not been fused tends to be wound around the fixing roller 72 to cause defective carriage of the printing medium 1. Therefore, the lower limit of temperature control of the rollers 71 and 72 is approximately a temperature equivalent to the transition temperature of the latex layer 1D to glass.

On the other hand, the upper limit of the temperature control of the rollers 71 and 72 is set in consideration of the fact that the printing medium 1 may become wavy or curled after the performance of heating fixation if the heating temperature exceeds 200° C. Further, for the printing medium whose basic material is PET, which is generally used for a printing apparatus, the strength of the printing medium itself is lost if the heating temperature exceeds 250° C. As a result, the printing medium tends to be wound around the fixing roller 72.

Ultimately, therefore, it is preferable to make the temperature control of the roller 71 and 72 within a range of 100° C. or more and 250° C. or less. More preferably, it is made within a range of 100° C. or more and 200° C. or less. Also, it is desirable to control the temperature of the rollers 71 and 72 depending on the kinds of printing medium 1, that is, it should be controlled in accordance with the materials of the base member 1A and latex layer 1D, or the like. Also, in consideration of the thermal influence that may be exerted on the printing medium 1, it is preferable to set the nipping gap of the rollers 71 and 72 at 3 mm to 8 mm, and also, set the speed of its passage at 15 to 30 seconds per printing medium 1 of A4 size which is vertically orientated when used for printing.

The temperature control of the decurling unit 80 is made in accordance with the kind of printing medium 1. As the examples of printing medium 1, there are cited for the description given below a baryta paper printing medium (hereinafter referred to a "paper base") which contains vegetable fiber as its main component, and presents the basis weight of 157 g/m$^2$, and a PET printing medium (hereinafter referred to as a "film base") whose base material 1A is 125 $\mu$m thick.

Both paper base and film base do not create any curls if only these are kept on the straight line during the period from heating to cooling in the heating fixation. This trend is particularly conspicuous for the film base. However, if the printing medium 1 should be kept on the straight line in the interior of the printing apparatus main body 100, it is inevitable that the apparatus should be made larger, and that the processing time becomes longer. This is not preferable. Therefore, it is arranged to enable the decurling unit 80 to correct the printing medium 1 by bending it in the direction opposite to the curling acquired by the printing medium. The rollers 81A and 81B in the decurling unit 80 are arranged to correct the printing medium 1 in the state which is made a convex looping directed downward as shown in FIG. 2. Also, when the printing medium 1 has been cooled once after the heating fixation, this decurling effect is made smaller. Therefore, the arrangement is made to control the surface temperature of the rubber roller 81B as described earlier.

In the decurling unit 80 thus provided, the decurling effect is enhanced when the temperature of the rubber roller 81B is made higher than 90° C. for the film base. It is more preferable to make it higher than 100° C. for obtaining a better decurling effect. However, if the temperature is made too high, the laminate layer is again fused to disturb the surface condition of the printing medium 1. In other words, it is preferable to set the control temperature of the decurling unit 80 lower than that of the heat fixing unit 70.

Here, in comparing the paper base and the film base, the decurling effect is more conspicuous for the latter than the former. This is because of the orientation of the base material 1A itself and the thermal contraction thereof. Therefore, the nipping amount of the rollers 81A and 81B is made larger for the paper base. The nipping amount thereof is made smaller for the film base. More specifically, for the former, the engrossed amount of surface of the metallic roller 81A to the surface of the rubber roller 81B is made 3 mm. For the latter, such engrossed amount is made 1 mm. In this manner, a good result is obtained. The engrossed amount of the surface of the metallic roller 81A to that of the rubber roller 81B is controlled by the slider 84 which moves vertically following the position of the rotational cam 85.

Further, the decurling effect is related to the given amount of heat generated by the fixing unit 70 and decurling unit 80. Here, therefore, in accordance with the present embodiment, the control temperature (heating fixation temperature) for the paper base in the unit 70 is set at 160° C. and the control temperature (decurling temperature) for it in the unit 80 is set at 80° C., while for the film base, the control temperature (heating fixation temperature) is set at 150° C. in the unit 70, and the control temperature (decurling temperature) is set at 80° C. in the unit 80 as the preferable examples of the respective control temperatures in both units. Also, in this respect, the same effect is obtainable if the heating fixation temperature for the paper base is set at 100° C. or more and 210° C. or less, while that for the film base is set at 100° C. or more and 200° C. or less. Further, the heating fixation temperature for the paper base should preferably be set within a range of (170±20)° C., and more preferably, within a range of (170±10)° C. for obtaining the decurling effect in a better condition. Also, the heating fixation temperature for the film base should preferably be set within a range of (160±20)° C., and more preferably, within a range of (160±10)° C. for obtaining the decurling effect in a better condition. Such conditions of temperature controls are changeable depending on the kinds of base material 1A and latex layer 1D. In case of the paper base, the laminated layer may be transferred to the fixing roller 72 due to excessive temperature if the fixing temperature is raised. In such case, it is effective to make arrangement so that the fixing temperature of the paper base should be made lower than that of the film base, and at the same time, the decurling temperature and the engrossed amount of surface of the metallic roller 81A to the surface of the rubber roller 81B are made greater than those arranged for the film base. Also, it may be possible to control the heating amount given to the printing medium 1 depending on the speed of passage of the printing medium in the units 70 and 80.

(Second Embodiment)

Now, the description will be made of the structure of a printing apparatus according to a second embodiment of the present invention. Particularly, a heat insulating member and its circumferential structure will be described. In this respect, the structure of the second embodiment is similar to that of the first embodiment unless otherwise mentioned.

Figure 5:
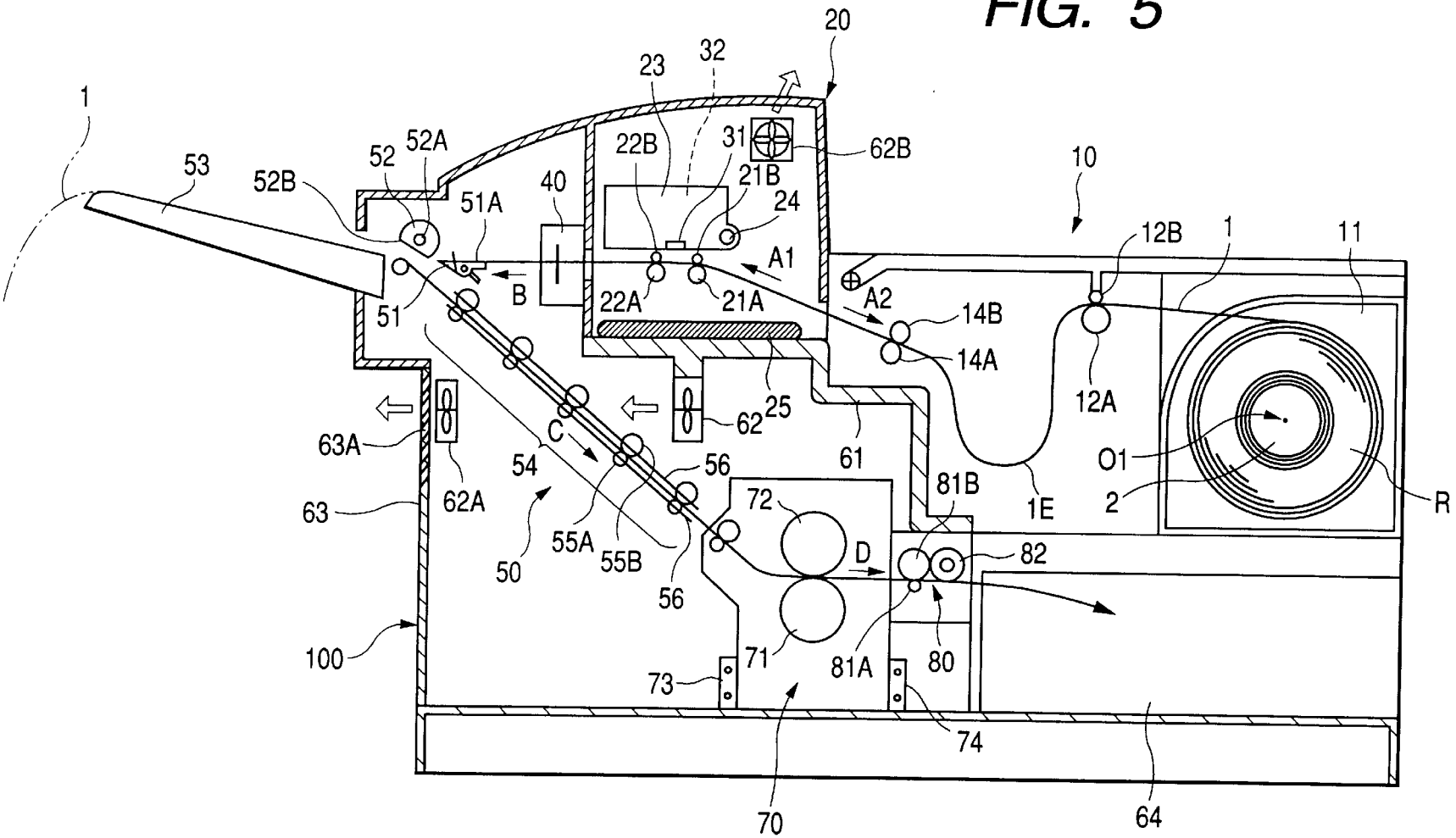
FIG. 5 is a view which schematically shows the entire structure of an image formation apparatus according to a second embodiment of the present invention.

FIG. 5 is a view which schematically illustrates the structure of a printing apparatus in accordance with the second embodiment of the present invention. This printing apparatus is such that a heat exhaust fan 62A and a heat exhaust fan 62B are further provided for the printing apparatus shown in FIG. 1 having the heat exhaust fan 62 installed in it.

The hot air blown out from the heat exhaust fan 62 in the left direction in FIG. 5 is exhausted outside the apparatus by means of the heat exhaust fan 62A. This arrangement contributes to suppressing the temperature rise resulting from the use of heaters. At the same time, the structure is arranged to prevent heat from being accumulated in the printing unit 20 with the provision of the fan 62B in the deep side of the printing unit 20 located on the upper part of FIG. 5. This fan also exhausts hot air outside the apparatus.

Figure 6:
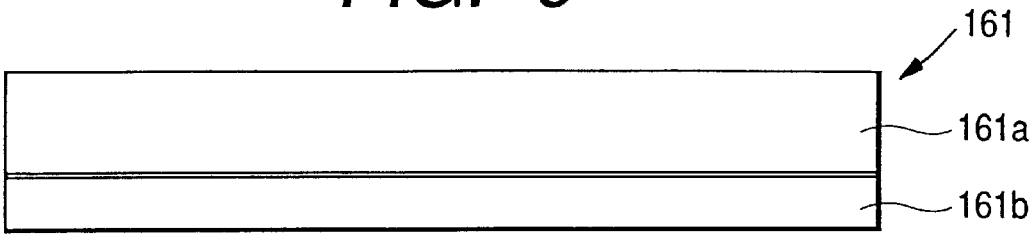
FIG. 6 is a view which schematically shows a heat insulating member in accordance with the second embodiment of the present invention.

Further, as shown in FIG. 6, a heat insulating member 161 is provided with a water proofing material 161*b* on the lower part of the heat insulating material 161*a*, that is, on the heat application treatment unit (fixing unit 70 and decurling unit 80) side, in order to insulate the transfer of water vapor from the heat application treatment unit side to the printing unit 20 side or to the cartridge type medium storage 11 side. This water proofing material 161*b* is aluminum, stainless steel, metallic plate or other metal, or a hard plastic or the like. Here, after the execution of ink jet printing, the heating fixation is performed for the printed medium in the fixing unit 70. At this juncture, moisture in the ink solvent is evaporated to generate water vapor. The insulating member formed by such material as described above prevents water vapor from being diffused to the cartridge type medium storage 11, the loop 1E portion or to the printing unit 20. In this manner, it becomes possible to prevent the quality of ink jet printing from being degraded due to the deviated discharge directions of ink droplets that may be caused by the adhesion of water droplets to the circumference of the ink discharge openings of the ink jet printing head or degraded because of the moistened printing medium.

Also, the heat insulating material 161*a* may be a versatile heat insulator, such as FUJILON 6000 (Registered Trademark).

Figure 7:
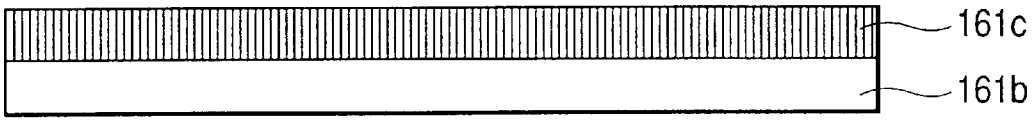
FIG. 7 is a view which schematically shows the heat insulating member represented in FIG. 6 in accordance with another embodiment of the present invention.

Further, as shown in FIG. 7, the heat insulating material 161*c*, which is provided with flocked piles or the like on one face of the water proofing material 161*b*, may be effectively adoptable. Particularly, if piles of 0.5 mm each are flocked as the heat insulating material 161*c* on the upper surface of a bonderized steel plate (approximately 1 mm thick) serving as the water proofing material 161*b*, it becomes possible to suppress the temperature rise of the printing unit 20 to 10° C. or less against the room temperature under the normal temperature operation in summer.

Also, a waste ink reservoir member 25 is arranged above such heat insulating member 161 but below the printing unit 20 or in the vicinity thereof. As a result, the waste ink reservoir member 25 is not affected by water vapor from the heat application treatment unit. Hence, the surrounding atmosphere of this member does not invite any increase of moisture in it, nor is there any possibility that the amount of natural evaporation of waste ink is reduced.

(Other Embodiments)

Figure 8:
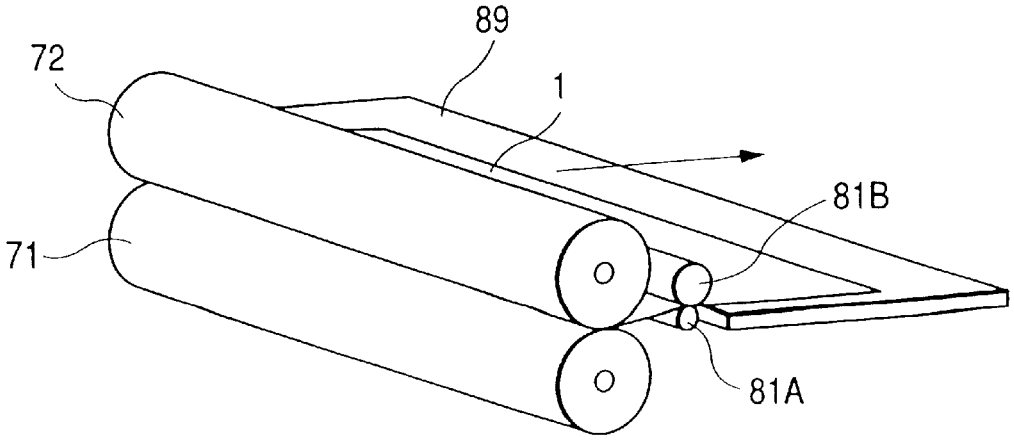
FIG. 8 is a perspective view which schematically shows a heat application treatment unit in accordance with another embodiment of the present invention.

FIG. 8 is a perspective view which schematically shows the main part of the fixing unit 70 and decurling unit 80 as another structural example of the heat application treatment unit in accordance with the present invention. The distance between the rollers 71, 72 and the rollers 81A and 81B is set so as not to allow the printing medium 1 to hang down by its own weight. Here, a reference numeral 89 designates a carrier guide that prevents the printing medium 1 from hanging down.

In the above-described first and second embodiments, the ink jet print unit is provided above the heat application treatment unit. However, the present invention is not limited to this arrangement. For example, a heat insulating member is provided between the ink jet print unit and the heat application treatment unit and the heat insulating member may have a heat insulating portion located on the ink jet print unit and the water-proof portion located on the heat application treatment unit so that it is possible to prevent the image quality from being degraded due to the heat or water vapor and moisture generated by the heat application treatment unit.

Also, as another structural example of the printing head 31, it may be possible to use an elongated head that extends in the direction substantially orthogonal to the carrying direction of the printing medium 1. In this case, the ink discharge openings of the head are arranged to face the entire recordable area of the printing medium 1 in the width direction thereof. Then, images are printed on the printing surface, while the printing medium 1 is being carried continuously. In such case, shock absorbing means 50 is arranged to receive the printing medium 1 which is carried continuously in the printing unit 20, and then, to transfer it continuously to the fixing unit 70 after its carrying speed is adjusted to agree with the passage speed thereof in the fixing unit 70.

Also, the printing medium is not necessarily limited to the rolled one. The printing medium may be a sheet having a specific length. Then, the cutter unit 40 is not necessarily provided.

As described above, in accordance with each of the embodiments of the present invention, it is possible to provide an ink jet printing apparatus capable of preventing heat generated by the heat application treatment unit from producing any unfavorable effect that may invite the degradation of printing quality if such heat is transferred to the various members in an ink jet printing apparatus, such as the ink jet printing unit, the printing medium storage unit, or to the bending portion of a printing medium between the ink jet printing unit and printing medium storage unit.

Further, it is possible to provide an ink jet printing apparatus capable of preventing water vapor from producing any unfavorable effect that may invite the degradation of printing quality when the water vapor is generated by heat treatment in the heat application treatment unit after the execution of ink jet printing.

What is claimed is:

1. An ink jet printing apparatus comprising:

an ink jet printing unit for executing ink jet printing on a printing medium by use of an ink jet printing head;

a heat application treatment unit arranged below said ink jet printing unit for executing heat treatment to a printing medium after the execution of ink jet printing by said ink jet printing unit;

a heat insulating member arranged between said ink jet printing unit and said heat application treatment unit; and a fan member disposed between said ink let printing unit and said heat application treatment unit and below said heat insulating member to exhaust heat of said heat application treatment unit.

2. An ink jet printing apparatus according to claim 1, wherein a printing medium storage unit is provided for storing said printing medium to be supplied to said ink jet printing unit.

3. An ink jet printing apparatus according to claim 2, wherein said printing medium storage unit stores said printing medium in a rolled form, a space being provided between said ink jet printing unit and said printing medium storage unit to accommodate slackening of said printing medium, and further, said heat insulating member is arranged between said heat application treatment unit and said space.

4. An ink jet printing apparatus according to claim 3, wherein said space accommodates the slackness of said printing medium which is formed as a bend by utilization of its own weight in the direction opposite to the direction of curvature of said printing medium in said printing medium storage unit.

5. An ink jet printing apparatus according to claim 1, wherein a water proofing member is arranged between said heat insulating member and said heat application treatment unit for preventing water vapor generated in said heat application treatment unit from being transferred to said heat insulating member side.

6. An ink jet printing apparatus according to claim 1, wherein a waste ink absorbing member is arranged for said heat insulating member on said ink jet printing unit side.

7. An ink jet printing apparatus according to claim 1, further comprising said printing medium, wherein said printing medium is provided with a thermoplastic layer having permeability of ink.

8. An ink jet printing apparatus according to claim 1, further comprising said printing medium, wherein said printing medium is provided with a thermoplastic layer having ink holding capability.

9. An ink jet printing apparatus according to claim 1, wherein said heat application treatment unit is provided with a first heat application treatment unit for giving heat to said printing medium after the execution of ink jet printing, and a second heat application treatment unit for giving heat in order to remove the curling of said printing medium generated by heat treatment in said first heat application treatment unit.

10. An ink jet printing apparatus according to claim 9, wherein said second heat application treatment unit comprises means for changing the amount of heat given to said printing medium in accordance with the kind of said printing medium.

11. An ink jet printing apparatus according to claim 1, wherein pre-heating means is arranged above said heat application treatment unit but below said heat insulating member for pre-heating said printing medium guided into said heat application treatment unit by utilization of heat generated by said heat application treatment unit.

12. An ink jet printing apparatus according to claim 11, wherein said pre-heating means exhausts heat generated by said heat application treatment unit to the outside of the apparatus through a given pre-heating position if said printing medium is not present in said pre-heating position.

13. An ink jet printing apparatus according to any one of claim 1 to claim 12, wherein said ink jet printing head is provided with electrothermal transducing devices to discharge ink from discharge openings by use of thermal energy generated by said electrothermal transducing devices.

14. An ink jet printing apparatus comprising:

an ink jet printing unit for performing ink jet printing on a printing medium by using an ink jet printing head;

a heat application treatment unit for applying heat to the printing medium after being printed by said ink jet printing unit;

a heat insulating member provided between the ink jet printing unit and the heat application treatment unit, said heat insulating member having a heat insulating portion located on the ink jet printing unit side and a water-proof portion located on the heat application treatment unit side;

a containing member defining a space for containing said heat application treatment unit with said heat insulating member; and a fan member disposed in said space to exhaust heat generated by said heat application treatment unit from said space.

15. An ink jet printing apparatus according to claim 14, wherein a printing medium storage unit is provided for storing said printing medium to be supplied to said ink jet printing unit.

16. An ink jet printing apparatus according to claim 15, wherein said printing medium storage unit stores said printing medium in a rolled form, a second space being provided between said ink jet printing unit and said printing medium storage unit to accommodate slackening of said printing medium, and further, said heat insulating member is arranged between said heat application treatment unit and said second space.

17. An ink jet printing apparatus according to claim 16, wherein said second space accommodates the slackness of said printing medium, which is formed as a bend by utilization of its own weight in the direction opposite to the direction of curvature of said printing medium in said printing medium storage unit.

18. An ink jet printing apparatus according to claim 14, wherein said water-proof portion is arranged between said heat insulating member and said heat application treatment unit for preventing water vapor generated in said heat application treatment unit from being transferred to said heat insulating member side.

19. An ink jet printing apparatus according to claim 14, wherein a waste ink absorbing member is arranged for said heat insulating member on said ink jet printing unit side.

20. An ink jet printing apparatus according to claim 14, further comprising said printing medium, wherein said printing medium is provided with a thermoplastic layer having permeability of ink.

21. An ink jet printing apparatus according to claim 14, further comprising said printing medium, wherein said printing medium is provided with a thermoplastic layer having ink holding capability.

22. An ink jet printing apparatus according to claim 14, wherein said heat application treatment unit is provided with a first heat application treatment unit for giving heat to said printing medium after the execution of ink jet printing, and a second heat application treatment unit for giving heat in order to remove the curling of said printing medium generated by heat treatment in said first heat application treatment unit.

23. An ink jet printing apparatus according to claim 22, wherein said second heat application treatment unit comprises means for changing the amount of heat given to said printing medium in accordance with the kind of said printing medium.

24. An ink jet printing apparatus according to claim 14, wherein pre-heating means is arranged above said heat application treatment unit but below said heat insulating member for pre-heating said printing medium guided into said heat application treatment unit by utilization of heat generated by said heat application treatment unit.

25. An ink jet printing apparatus according to claim 24, wherein said pre-heating means exhausts heat generated by said heat application treatment unit to the outside of the apparatus through a given pre-heating position if said printing medium is not present in said pre-heating position.

26. An ink jet printing apparatus according to any one of claim 14 to claim 25, wherein said ink jet printing head is provided with electrothermal transducing devices to discharge ink from discharge openings by use of thermal energy generated by said electrothermal transducing devices.

27. An ink jet printing apparatus comprising:

an ink jet printing unit for executing ink jet printing on a printing medium by use of an ink jet printing head;

a heat application treatment unit arranged below said ink jet printing unit for executing heat treatment to a printing medium after the execution of ink jet printing by said ink jet printing unit;

a heat insulating member arranged between said ink jet printing unit and said heat application treatment unit; and a water proofing member arranged between said heat insulating member and said heat application treatment unit for preventing water vapor generated in said heat application treatment unit from being transferred to said heat insulating member side.

28. An ink jet printing apparatus according to claim 27, wherein a printing medium storage unit is provided for storing said printing medium to be supplied to said ink jet printing unit.

29. An ink jet printing apparatus according to claim 28, wherein said printing medium storage unit stores said printing medium in a rolled form, a space being provided between said ink jet printing unit and said printing medium storage unit to accommodate slackening of said printing medium, and further, said heat insulating member is arranged between said heat application treatment unit and said space.

30. An ink jet printing apparatus according to claim 29, wherein said space accommodates the slackness of said printing medium, which is formed as a bend by utilization of its own weight in the direction opposite to the direction of curvature of said printing medium in said printing medium storage unit.

31. An ink jet printing apparatus according to claim 27, wherein a waste ink absorbing member is arranged for said heat insulating member on said ink jet printing unit side.

32. An ink jet printing apparatus according to claim 27, further comprising said printing medium, wherein said printing medium is provided with a thermoplastic layer having permeability of ink.

33. An ink jet printing apparatus according to claim 27, further comprising said printing medium, wherein said printing medium is provided with a thermoplastic layer having ink holding capability.

34. An ink jet printing apparatus according to claim 27, wherein said heat application treatment unit is provided with a first heat application treatment unit for giving heat to said printing medium after the execution of ink jet printing, and a second heat application treatment unit for giving heat in order to remove the curling of said printing medium generated by heat treatment in said first heat application treatment unit.

35. An ink jet printing apparatus according to claim 34, wherein said second heat application treatment unit comprises means for changing the amount of heat given to said printing medium in accordance with the kind of said printing medium.

36. An ink jet printing apparatus according to claim 27, wherein pre-heating means is arranged above said heat application treatment unit but below said heat insulating member for pre-heating said printing medium guided into said heat application treatment unit by utilization of heat generated by said heat application treatment unit.

37. An ink jet printing apparatus according to claim 36, wherein said pre-heating means exhausts heat generated by said heat application treatment unit to the outside of the apparatus through a given pre-heating position if said printing medium is not present in said pre-heating position.

38. An ink jet printing apparatus according to any one of claim 27 to claim 37, wherein said ink jet printing head is provided with electrothermal transducing devices to discharge ink from discharge openings by use of thermal energy generated by said electrothermal transducing devices.

39. An ink jet printing apparatus comprising:

an ink jet printing unit for executing ink jet printing on a printing medium by use of an ink jet printing head;

a heat application treatment unit arranged below said ink jet printing unit for executing heat treatment to a printing medium after the execution of ink jet printing by said ink jet printing unit;

a heat insulating member arranged between said ink jet printing unit and said heat application treatment unit; and pre-heating means arranged above said heat application treatment unit but below said heat insulating member for pre-heating said printing medium guided into said heat application treatment unit by utilization of heat generated by said heat application treatment unit.

40. An ink jet printing apparatus according to claim 39, wherein a printing medium storage unit is provided for storing said printing medium to be supplied to said ink jet printing unit.

41. An ink jet printing apparatus according to claim 40, wherein said printing medium storage unit stores said printing medium in a rolled form, a space being provided between said ink jet printing unit and said printing medium storage unit to accommodate slackening of said printing medium, and further, said heat insulating member is arranged between said heat application treatment unit and said space.

42. An ink jet printing apparatus according to claim 41, wherein said space accommodates the slackness of said printing medium, which is formed as a bend by utilization of its own weight in the direction opposite to the direction of curvature of said printing medium in said printing medium storage unit.

43. An ink jet printing apparatus according to claim 39, wherein a waste ink absorbing member is arranged for said heat insulating member on said ink jet printing unit side.

44. An ink jet printing apparatus according to claim 39, further comprising said printing medium, wherein said printing medium is provided with a thermoplastic layer having permeability of ink.

45. An ink jet printing apparatus according to claim 39, further comprising said printing medium, wherein said printing medium is provided with a thermoplastic layer having ink holding capability.

46. An ink jet printing apparatus according to claim 39, wherein said heat application treatment unit is provided with a first heat application treatment unit for giving heat to said printing medium after the execution of ink jet printing, and a second heat application treatment unit for giving heat in order to remove the curling of said printing medium generated by heat treatment in said first heat application treatment unit.

47. An ink jet printing apparatus according to claim 46, wherein said second heat application treatment unit comprises means for changing the amount of heat given to said printing medium in accordance with the kind of said printing medium.

48. An ink jet printing apparatus according to claim 39, wherein said pre-heating means exhausts heat generated by said heat application treatment unit to the outside of the apparatus through a given pre-heating position if said printing medium is not present in said pre-heating position.

49. An ink jet printing apparatus according to any one of claim 39 to claim 48, wherein said ink jet printing head is provided with electrothermal transducing devices to discharge ink from discharge openings by use of thermal energy generated by said electrothermal transducing devices.

50. An ink jet printing apparatus comprising:

an ink jet printing unit for performing ink jet printing on a printing medium by using an ink jet printing head;

a heat application treatment unit for applying heat to the printing medium after being printed by said ink jet printing unit;

a heat insulating member provided between the ink jet printing unit and the heat application treatment unit, said heat insulating member having a heat insulating portion located on the ink jet printing unit side and a water-proof portion located on the heat application treatment unit side; and pre-heating means arranged above said heat application treatment unit but below said heat insulating member for pre-heating said printing medium guided into said heat application treatment unit by utilization of heat generated by said heat application treatment unit.

51. An ink jet printing apparatus according to claim 50, wherein a printing medium storage unit is provided for storing said printing medium to be supplied to said ink jet printing unit.

52. An ink jet printing apparatus according to claim 51, wherein said printing medium storage unit stores said printing medium in a rolled form, a space being provided between said ink jet printing unit and said printing medium storage unit to accommodate slackening of said printing medium, and further, said heat insulating member is arranged between said heat application treatment unit and said space.

53. An ink jet printing apparatus according to claim 52, wherein said space accommodates the slackness of said printing medium, which is formed as a bend by utilization of its own weight in the direction opposite to the direction of curvature of said printing medium in said printing medium storage unit.

54. An ink jet printing apparatus according to claim 50, wherein said water-proof portion is arranged between said heat insulating member and said heat application treatment unit for preventing water vapor generated in said heat application treatment unit from being transferred to said heat insulating member side.

55. An ink jet printing apparatus according to claim 50, wherein a waste ink absorbing member is arranged for said heat insulating member on said ink jet printing unit side.

56. An ink jet printing apparatus according to claim 50, further comprising said printing medium, wherein said printing medium is provided with a thermoplastic layer having permeability of ink.

57. An ink jet printing apparatus according to claim 50, further comprising said printing medium, wherein said printing medium is provided with a thermoplastic layer having ink holding capability.

58. An ink jet printing apparatus according to claim 50, wherein said heat application treatment unit is provided with a first heat application treatment unit for giving heat to said printing medium after the execution of ink jet printing, and a second heat application treatment unit for giving heat in order to remove the curling of said printing medium generated by heat treatment in said first heat application treatment unit.

59. An ink jet printing apparatus according to claim 58, wherein said second heat application treatment unit comprises means for changing the amount of heat given to said printing medium in accordance with the kind of said printing medium.

60. An ink jet printing apparatus according to claim 50, wherein said pre-heating means exhausts heat generated by said heat application treatment unit to the outside of the apparatus through a given pre-heating position if said printing medium is not present in said pre-heating position.

61. An ink jet printing apparatus according to any one of claim 50 to claim 60, wherein said ink jet printing head is provided with electrothermal transducing devices to discharge ink from discharge openings by use of thermal energy generated by said electrothermal transducing devices.

62. An ink jet printing apparatus comprising:

an ink jet printing unit for executing ink jet printing on a printing medium by use of an ink jet printing head;

a heat application treatment unit for applying heat to the printing medium after being printed by said ink jet printing unit;

an heat insulating member arranged between said ink jet printing unit and said heat application treatment unit; and a water proofing member arranged between said heat insulating member and said heat application treatment unit for preventing water vapor generated in said heat application treatment unit from being transferred to said heat insulating member side.

63. An ink jet printing apparatus according to claim 62, wherein a printing medium storage unit is provided for storing said printing medium to be supplied to said ink jet printing unit.

64. An ink jet printing apparatus according to claim 63, wherein said printing medium storage unit stores said printing medium in a rolled form, a space being provided between said ink jet printing unit and said printing medium storage unit to accommodate slackening of said printing medium, and further, said heat insulating member is arranged between said heat application treatment unit and said space.

65. An ink jet printing apparatus according to claim 64, wherein said space accommodates the slackness of said printing medium, which is formed as a bend by utilization of its own weight in the direction opposite to the direction of curvature of said printing medium in said printing medium storage unit.

66. An ink jet printing apparatus according to claim 62, wherein a waste ink absorbing member is arranged for said heat insulating member on said ink jet printing unit side.

67. An ink jet printing apparatus according to claim 62, further comprising said printing medium, wherein said printing medium is provided with a thermoplastic layer having permeability of ink.

68. An ink jet printing apparatus according to claim 62, further comprising said printing medium, wherein said printing medium is provided with a thermoplastic layer having ink holding capability.

69. An ink jet printing apparatus according to claim 62, wherein said heat application treatment unit is provided with a first heat application treatment unit for giving heat to said printing medium after the execution of ink jet printing, and a second heat application treatment unit for giving heat in order to remove the curling of said printing medium generated by heat treatment in said first heat application treatment unit.

70. An ink jet printing apparatus according to claim 69, wherein said second heat application treatment unit comprises means for changing the amount of heat given to said printing medium in accordance with the kind of said printing medium.

71. An ink jet printing apparatus according to claim 62, wherein pre-heating means is arranged above said heat application treatment unit but below said heat insulating member for pre-heating said printing medium guided into said heat application treatment unit by utilization of heat generated by said heat application treatment unit.

72. An ink jet printing apparatus according to claim 71, wherein said pre-heating means exhaust heat generated by said heat application treatment unit to the outside of the apparatus through a given pre-heating position if said printing medium is not present in said pre-heating position.

73. An ink jet printing apparatus according to any one of claims 62 to claim 72, wherein said ink jet printing head is provided with electrothermal transducing devices to discharge ink from discharge openings by use of thermal energy generated by said electrothermal transducing devices.

74. An ink jet printing apparatus comprising:

an ink jet printing unit for executing ink jet printing on a printing medium by use of an ink jet printing head;

a heat application treatment unit for applying heat to the printing medium after being printed by said ink jet printing unit; and an insulating member arranged between said ink jet printing unit and said heat application treatment unit, one side of said insulating member being provided with a heat insulating portion and another side of said insulating member being provided with a water proofing portion arranged for preventing water vapor generated in said heat application treatment unit from being transferred to said heat insulating portion side.

75. An ink jet printing apparatus according to claim 74, wherein said heat insulating portion is provided in said insulating member on a side of said ink jet printing unit and said water proofing portion is provided on said insulating portion on a side of said heat application treatment unit.

76. An ink jet printing apparatus according to claim 74, wherein a printing medium storage unit is provided for storing said printing medium to be supplied to said ink jet printing unit.

77. An ink jet printing apparatus according to claim 76, wherein said printing medium storage unit stores said printing medium in a rolled form, a space being provided between said ink jet printing unit and said printing medium storage unit to accommodate slackening member is arranged medium, and further, said insulating member is arranged between said heat application treatment unit and said space.

78. An ink jet printing apparatus according to claim 77, wherein said space accommodates the slackness of said printing medium, which is formed as a band by utilization of its own weight in the direction opposite to the direction of curvature of said printing medium in said printing medium storage unit.

79. An ink jet printing apparatus according to claim 74, wherein a waste ink absorbing member is arranged for said insulating member on said ink jet printing unit side.

80. An ink jet printing apparatus according to claim 74, further comprising said printing medium, wherein said printing medium is provided with a thermoplastic layer having permeability of ink.

81. An ink jet printing apparatus according to claim 74, further comprising said printing medium, wherein said printing medium is provided with a thermoplastic layer having ink holding capability.

82. An ink jet printing apparatus according to claim 74, wherein said heat application treatment unit is provided with a first heat application treatment unit for giving heat to said printing medium after the execution of ink jet printing, and a second heat application treatment unit for giving heat in order to remove the curling of said printing medium generated by heat treatment in said first heat application treatment unit.

83. An ink jet printing apparatus according to claim 82, wherein said second heat application treatment unit comprises means for changing the amount of heat given to said printing medium in accordance with the kind of said printing medium.

84. An ink jet printing apparatus according to claim 74, wherein pre-heat means is arranged above said heat application treatment unit but below said insulating member for pre-heating said printing medium guided into said heat application treatment unit by utilization of heat generated by said heat application treatment unit.

85. An ink jet printing apparatus according to claim 84, wherein said pre-heating means exhausts heat generated by said heat application treatment unit to the outside of the apparatus through a given pre-heating position if said printing medium is not present in said pre-heating position.

86. An ink jet printing apparatus according to any one of claims 74, to claim 85, wherein said ink jet printing head is provided with electrothermal transducing devices to discharge ink from discharge openings by use of thermal energy generated by said electrothermal transducing devices.

* * * * *

UNITED STATES PATENT AND TRADEMARK OFFICE

CERTIFICATE OF CORRECTION

PATENT NO. : 6,120,199

DATED : September 19, 2000

INVENTOR(S) : TAKEKOSHI

It is certified that error appears in the above-identified patent and that said Letters Patent is hereby corrected as shown below:

COLUMN 1:
Line 36, "other" should read --other components--.
Line 40, "of" (second occurrence) should be deleted.

COLUMN 3:
Line 27, "rollers Ri" should read --rollers R1--.
Line 43, "also," should read --Also,--.

COLUMN 4:
Line 8, "unit 29," should read --unit 20,--.
Line 64, "it is," should read --it is--.

COLUMN 6:
Line 54, "roller" should read --rollers--.

COLUMN 7:
Line 21, "roller" should read --rollers--.

COLUMN 8:
Line 36, "roller" should read --rollers--.

COLUMN 9:
Line 24, "roller" should read --rollers--.
Line 41, "to a" should read --to as a--.

COLUMN 11:
Line 23, "printed" should read --printing--.

UNITED STATES PATENT AND TRADEMARK OFFICE

CERTIFICATE OF CORRECTION

PATENT NO. : 6,120,199

DATED : September 19, 2000

INVENTOR(S) : TAKEKOSHI

It is certified that error appears in the above-identified patent and that said Letters Patent is hereby corrected as shown below:

COLUMN 12:
Line 56, "let" should read --jet--.

COLUMN 13:
Line 7, "medium" should read --medium,--.

COLUMN 18:
Line 29, "an" should read --a--.

COLUMN 19:
Line 19, "exhaust" should read --exhausts--.
Line 24, "claims 62" should read --claim 62--.

COLUMN 20:
Line 3, "member is arranged" should read --of said printing--.
Line 8, "band" should read --bend--.
Line 37, "pre-heat" should read --pre-heating--.
Line 48, "claims 74," should read --claim 74--.

Signed and Sealed this

Twenty-ninth Day of May, 2001

*Attest:*

Nicholas P. Godici

NICHOLAS P. GODICI

*Attesting Officer*

*Acting Director of the United States Patent and Trademark Office*